US005913256A

United States Patent [19]

Lowden et al.

[11] Patent Number: 5,913,256

[45] Date of Patent: Jun. 15, 1999

[54] NON-LEAD ENVIRONMENTALLY SAFE PROJECTILES AND EXPLOSIVE CONTAINER

[75] Inventors: Richard A. Lowden, Clinton; Thomas M. McCoig, Maryville; Joseph B. Dooley, Kingston; Cyrus M. Smith, Knoxville, all of Tenn.

[73] Assignee: Lockheed Martin Energy Systems, Inc., Oak Ridge, Tenn.

[21] Appl. No.: 08/966,790

[22] Filed: Nov. 10, 1997

Related U.S. Application Data

[63] Continuation of application No. 08/476,978, Jun. 7, 1995, abandoned, which is a continuation-in-part of application No. 08/267,895, Jul. 6, 1993, abandoned.

[51] Int. Cl.[6] ..... C22C 27/04

[52] U.S. Cl. ..... 75/248; 75/240; 75/245; 102/516; 102/517

[58] Field of Search ..... 75/240, 248, 245, 75/247; 102/448, 449, 459, 495, 516, 517

[56] References Cited

U.S. PATENT DOCUMENTS

| | | | |
|---|---|---|---|
| 13,799 | 11/1855 | Sawyer . | |
| 1,732,211 | 10/1929 | Olin et al. . | |
| 2,172,054 | 9/1939 | Di Brazza et al. . | |
| 3,112,700 | 12/1963 | Gehring, Jr. . | |
| 3,305,324 | 2/1967 | Krock et al. . | |
| 3,393,056 | 7/1968 | Zdanuk et al. . | |
| 3,449,120 | 6/1969 | Zdanuk et al. . | |
| 3,463,047 | 8/1969 | Germershausen . | |
| 3,791,818 | 2/1974 | Watmough et al. | 75/126 P |
| 3,946,673 | 3/1976 | Hayes . | |
| 4,329,175 | 5/1982 | Turner | 75/2.08 R |
| 4,338,713 | 7/1982 | Christopher | 29/420.5 |
| 4,428,295 | 1/1984 | Urs . | |
| 4,498,395 | 2/1985 | Kock et al. . | |
| 4,613,370 | 9/1986 | Held et al. | 75/248 |
| 4,628,819 | 12/1986 | Backofen, Jr. et al. | 102/307 |
| 4,649,829 | 3/1987 | Bilsbury . | |
| 4,662,280 | 5/1987 | Becker et al. | 102/364 |
| 4,685,397 | 8/1987 | Schirneker . | |
| 4,760,794 | 8/1988 | Allen | 102/473 |
| 4,765,566 | 8/1988 | Fixell et al. | 244/323 |
| 4,779,535 | 10/1988 | Maki | 102/501 |
| 4,881,465 | 11/1989 | Hooper et al. . | |
| 4,911,625 | 3/1990 | Begg et al. | 419/6 |
| 5,049,184 | 9/1991 | Harner et al. | 75/246 |
| 5,127,332 | 7/1992 | Corzine et al. . | |
| 5,175,391 | 12/1992 | Walters et al. | 102/307 |
| 5,237,930 | 8/1993 | Belanger et al. . | |
| 5,264,022 | 11/1993 | Haygarth et al. . | |
| 5,279,787 | 1/1994 | Oltrogge | 419/38 |
| 5,399,187 | 3/1995 | Mravic et al. | 75/228 |

FOREIGN PATENT DOCUMENTS

| | | |
|---|---|---|
| 809181 | 12/1936 | France . |
| 36 34433 - A1 | 4/1988 | Germany . |
| 199958 | 7/1923 | United Kingdom . |

OTHER PUBLICATIONS

Seung–Ki Joo, et al. "Effect of Cobalt Addition on the Liquid–Phase Sintering of W–Cu Prepared by the Fluidized Bed Reduction Method," Metal. and Materials Transactions A, vol. 25 A, Aug. 1994.

*Primary Examiner*—Ngoclan Mai

[57] ABSTRACT

A solid object having controlled frangibility, such as a bullet or a container for explosives, is made by combining two different metals in proportions calculated to achieve a desired density, without using lead. A wetting material is deposited on the base constituent which is made of a relative dense, hard material. The wetting material enhances the wettability of the base constituent with the binder constituent, which is lighter and softer than the base constituent.

75 Claims, 4 Drawing Sheets

NON-LEAD ENVIRONMENTALLY SAFE PROJECTILES AND EXPLOSIVE CONTAINER

This is a continuation of Ser. No. 08/476,978, filed on Jun. 7, 1995 now abandoned, which is a C-I-P of Ser. No. 08/267,895, filed Jul. 6, 1993, now abandoned.

This invention was made with government support under Contract No. DE-AC05-840R21400 awarded by the U.S. Department of Energy to Martin Marietta Energy Systems, Inc. and the government has certain rights in this invention.

FIELD OF THE INVENTION

The present invention relates generally to powder metallurgy, and more specifically, to projectiles or other objects made from consolidated powdered materials. The materials are chosen to emulate or improve upon the mechanical properties and mass of lead.

DESCRIPTION OF THE RELATED ART

Bullets are a type of projectile which have relied on the density of lead to generate a desirable force, commonly measured in foot pounds of energy, when propelled at a desired velocity.

One type of bullet includes a lead core jacketed with copper. This type of construction and combination of materials has been used successfully because the density of lead produces desirable ballistic performance. Moreover, the ductility and malleability of lead makes it easily worked into projectile shapes, and produces desirable impact deformation.

Lead-containing bullets present both environmental and safety problems, when fired at practice ranges. Health issues arise from breathing airborne lead contaminants generated from firing the projectiles and their impact on the backstop. Environmentally, lead from the projectiles fired at an outdoor range accumulates in the ground and can leach into surface water and ground water. In terms of safety, projectiles fired indoors or outdoors can ricochet and thereby cause unintended collateral damage.

The safety, health and environmental issues with regards to the firing of projectiles at ranges and other training facilities (or in general, any training exercise where projectiles are fired into the environment) have prompted the development and evaluation of alternative ammunition that eliminates the undesirable health, safety and environmental aspects of lead.

It has not been a simple matter to replace lead as a material for making projectiles. Alternative projectiles considered in the past have not been able to maintain the mechanical and physical properties of lead so as to achieve comparable performance. For example, the ability of the projectile to retain its velocity and energy is measured by its sectional density is proportional to the projectile mass divided by the square of the caliber. Thus, it is seen that a projectile of low mass or density will not retain its velocity and energy as well as a projectile of higher mass and energy.

Recent efforts to replace lead in bullets have focused on powdered metals with polymer binders, plastic or rubber projectiles, and bismuth metal. However, these replacements have yet to meet all desired specifications and performance goals.

At the end of World War II, projectiles used in 50 caliber weapons for training, and to replace lead, were fabricated from tungsten, iron, and bakelite. These were used for some time in training exercises and for special applications. However, attempts to reproduce these materials in the early 1970's were unsuccessful. In addition, bakelite, which is fabricated from phenolic-formaldehyde mixtures, has experienced declining usage as newer, less expensive polymer materials have been developed.

Frangible projectiles are also employed as training ammunition in place of kinetic energy penetrators. The simulated projectiles must exhibit similar flight characteristics to the actual penetrators, but ideally self-destruct in flight or on impact for safety reasons (for example, to reduce ricochet). A partially densified iron powder component encased in a low-strength, thermally-degradable plastic container has been used. These replacement projectiles fail on light impact or after heating in flight, thus meeting range safety requirements.

Commercially available non-lead, frangible munitions for training and certification of personnel are presently being fabricated using bullets formed from tungsten and copper powders in a nylon matrix. The projectiles are a direct spin-off from technologies first explored for replacing lead weights used by commercial fishermen in Europe. The projectiles are formed employing injection molding techniques and various lots have been delivered to various organizations for testing.

While the aforementioned ammunition is functional, the density of the bullet material is only approximately half that of the lead-containing components (5.8 versus 11.4 g/cm$^3$). The low weight of the projectile causes problems in weapon functionality and accuracy, especially at extended ranges.

Another solution being explored is the replacement of lead with other metals such as bismuth. Bismuth metal possesses properties similar to those of lead. Shotgun ammunition that utilizes bismuth shot is also commercially available, but the density of this metal is only 86% of that of lead (9.8 versus 11.4 g/cm$^3$), and again this creates concerns with regards to ballistic performance.

In pelletized projectiles, such as shotgun shot, lead has been used for many years in hunting waterfowl and other game birds. Where lead shot has been banned, steel shot has been required. However, due to the high hardness and strength, and low density (7.5 versus 11.4 g/cm$^3$), steels are less desirable choices for use as projectile materials.

Steel shot has also caused intense controversy for it is believed that due to its reduced ballistic properties (primarily to the lower density), many birds are being wounded and maimed, dying gruesome deaths. The manufacturers recommend using a steel shot at least two sizes larger in diameter than lead for the same target and similar distances. This further diminishes effectiveness by decreasing pattern density (the number of pellets in the shot change).

Although ammunition manufacturers are developing new and improved components for use with steel shot, the ammunition appears to cause excessive wear and undue damage to many shotgun barrels.

Several United States patents have described lead-less or lead-reduced projectiles. For example, U.S. Pat. No. 5,264,022 to Haygarth et al. describes a lead-free shotshell pellet made of an alloy of iron and tungsten. The pellets may be coated with a polymeric coating, resin or lubricant.

U.S. Pat. No. 4,881,465 to Hooper et al. discloses a non-lead shotgun pellet in which particles made of a first alloy are suspended in a matrix of a second alloy. The first alloy is primarily ferrotungsten, and the second alloy is primarily lead. The second alloy is poured over crushed particles of the first alloy to form the pellets.

U.S. Pat. No. 4,498,395 to Kock et al. discloses a powder made of tungsten particles coated with either nickel, copper, silver, iron, cobalt, molybdenum or rhenium, wherein the particle diameters are in the range of 10 to 50 $\mu$m. The particles are sintered to form projectiles.

U.S. Pat. No. 4,428,295 to Venkataramaraj discloses a high density shot made of a cold-compacted mixture of at least two metal powders. A representative mixture includes 50% lead and 50% tungsten, which is cold pressed in shot molds at 20,000 psi.

It is clear from the above that several attempts have been made in the past to obviate or diminish the use of lead as a primary material for making projectiles. Yet, no one heretofore has achieved satisfactory performance from non-lead materials.

Explosive charges are typically packaged in metallic or polymer-metal containers. These containers protect the explosive charge from the environment and from damage by handling, and also contain the expanding gases for a short period of time (microseconds) during detonation. Moreover, for shaped charges, the container assists in the shaping of the discharge gas jet or penetrator. In particular military applications, the container provides collateral damage through fragmentation.

The ductility of the container material and the reactive mass of the container both assist in the initial containment of the expanding gases during detonation. This initial containment influences the efficiency of the explosive charge. As noted, the fragmentation effects of the container may be desirable in certain military applications; however, there are situations where explosive charges are utilized where no fragmentation effects are desired or where the fragmentation effects need to be controlled such that they occur only within a limited area.

The concept of a frangible container for non-lethal or enhanced blast explosive charges is not new. Various materials have been utilized with varying degrees of success. All have fallen short of providing the explosive charge designer with the ability to control the frangibility of the container, and thus, the containment of the expanding gases, the shaping of the discharge jet or penetrator, and the collateral effects of fragmentation. To assist in controlling the initial containment of the expanding gases, the designer must be able to balance the reactive mass of the container with the ductility of the material.

To assist in controlling the shape of the discharge jet or penetrator of a shaped charge, the designer must balance the forming of the shaped penetrator (if applicable) with the controlled opening of the container.

To assist in controlling the collateral effects of fragmentation, the designer must balance the expected fragment size, shape, and velocity to assure sufficient kinetic energy of some fraction of the fragments within the specified area while assuring that air resistance has decreased velocity sufficiently for each fragment to have insufficient kinetic energy for damage or penetration outside the specified area.

SUMMARY OF THE INVENTION

An object of the present invention is to provide a method of forming projectiles from at least two constituent materials, wherein the materials may or may not be treated with a wetting agent, depending on the exact properties desired, to enhance wetting of one material by the other material, thereby enhancing bonding between phases and ensuring consolidation of the two materials when subjected to a densification step.

Another object of the present invention is to provide a container for explosives, wherein frangibility of the container is controlled to achieve a desired pyrotechnic effect.

These and other objects of the invention are achieved by providing a method of forming a projectile which includes coating a first powdered material with a wetting agent, mixing the coated first powdered material with a second powdered material, and densify the mixed first and second powdered materials to form a projectile. The first material is a relatively hard, high density metal or compound that is preferably heavier than lead, while the second material is a lighter, softer metal that acts as a binder and as a buffer between the high density particles and the steel barrel of a weapon.

To avoid separation of the two or more constituents during handling and processing, the lighter, softer metal may be coated on the heavier metal, and then the coated particles are consolidated through a working process into projectile shapes.

Another aspect of the invention is to provide a container for explosives wherein the frangibility of the container is controlled by selection of materials and processing conditions.

Other objects and advantages which will be subsequently apparent, reside in the details of construction and operation as more fully hereinafter described and claimed, with reference being had to the accompanying drawings forming a part hereof, wherein like numerals refer to like elements throughout.

DETAILED DESCRIPTION OF THE PREFERRED EMBODIMENTS

The present invention provides non-lead frangible projectiles which can be used instead of lead-containing products, thus obviating environmental problems associated with conventional projectiles.

According to one aspect of the present invention, coated metal or metal compound powders and particulates are used as base materials. The projectiles can be constructed to maintain the density and ballistic properties of present lead-containing components, but without using toxic materials. Moreover, the materials can be selected, mixed and processed to achieve controlled impact behavior.

The use of coated particulates allows for uniform distribution of each component, controlled composition and density, and tailorable impact behavior through selection of materials, processing conditions, final porosity, and adherence or bonding of the coatings and between particulates.

Figure 1:
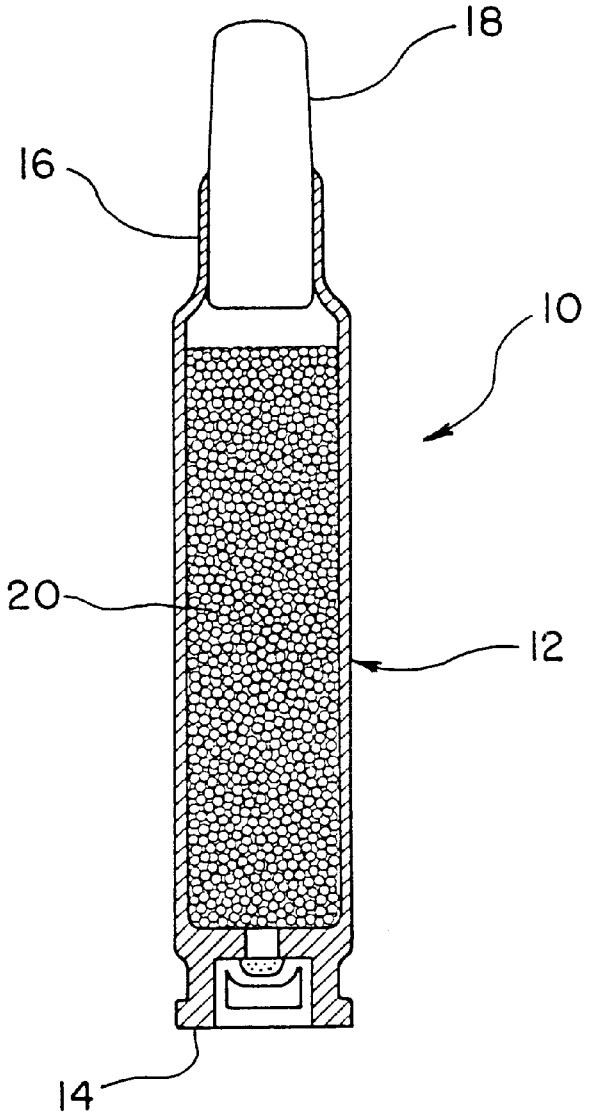
FIG. 1 is a vertical cross-sectional view of a munitions cartridge which includes a bullet or projectile made according to the present invention.

In one application of a projectile illustrated in FIG. 1, a munitions cartridge 10 includes a casing 12 having a primer 14 at one end and a bullet-receiving opposite end 16. A bullet 18, serving as the "projectile", is fitted into the receiving end 16 of the casing 12. As is standard in the art, a charge of powder 20 contained in the casing 12 is ignited by the primer 14, when acted upon by a firing pin, to propel the bullet 18 down the gun barrel. This general principle of operation also applies to cannon and howitzers using "fixed" ammunition rounds. These larger guns may replace projectile 18, with an explosive shell, similar to FIG. 10, and may use different types of primers. Except for size, the components are identical.

According to another aspect of the present invention, the bullet 18 is made by mixing a base constituent, which is heavier than lead, with a binder constituent, which is lighter than lead. The binder constituent is selected to have a degree of malleability and ductility which facilitates formation of a desirable projectile shape when the mixed constituents are subjected to a consolidation process. Toxic materials, such as lead, are not used for either constituent.

The simplest process of fabrication is to blend the base constituent and the binder constituent and then consolidate the blend into projectile shapes using a low energy working technique, such as cold (room temperature or slightly heated) pressing.

The base constituent is preferably a high density, high hardness powdered material. This constituent may be a metal, metal compound, metal alloy, or mixtures of the aforementioned, and should have a density greater than lead. The binder constituent may also be a metal, metal compound, metal alloy, or mixtures of same, and is softer and less dense than the base constituent.

The higher density base constituent provides mass while the softer, lighter binder constituent acts as a buffer against the steel barrel of a weapon. Prior art projectiles which use lead as a binder do not solve the environmental problem, while those using hard exposed substitutes damage barrels and/or do not have controllable frangibility.

Figure 2:
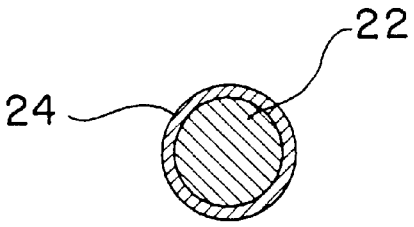
FIG. 2 is an enlarged sectional view of a coated particle used to make projectiles according to the present invention.

Because metal powders of different density tend to separate during handling and processing, a particular embodiment of the present invention involves coating powders made of the primary (heavier) constituent material with the lighter binder constituent. This is illustrated in FIG. 2, wherein a spherical particle 22 made of the primary constituent is coated with a coating 24. The coating 24 is made of the softer, typically lower density binder constituent.

The thickness of the coating 24 and the size of the particle 22 can be selected to control the fraction of each metal in the final component, and thus the density of the projectile. The use of coated powders allows for precise control of composition and results in uniform distribution of each metal throughout the part. In addition, the coating 24 on individual particles 22 ensures that the heavier, harder base constituent, such as tungsten, does not contact and thereby abrade the inside surfaces of the gun barrel.

The coating 24 can be formed in a variety of ways, including fluidized bed and tumbling-bed chemical vapor deposition, electroplating, or other metal deposition processes. A uniform coating of controlled thickness can readily be deposited on powders or particulates of a broad range of sizes and densities.

The coated powders are mixed (if more than one base constituent is used) and pressed, and if necessary, sintered to produce a projectile or other component. The physical properties such as density, hardness, porosity, impact properties, etc. can be controlled through selection of material and powder, particle size, coating material, coating thickness and processing conditions.

The use of coated powders enhances the ability to control projectile frangibility over a broad range by introducing new variables not found in monolithic metals. These include the bonding of the coating to particle, and particle to particle contact and bonding during consolidation. Thus, projectiles with controllable density and impact properties are fabricated employing coated powders and particulates.

Figure 3:
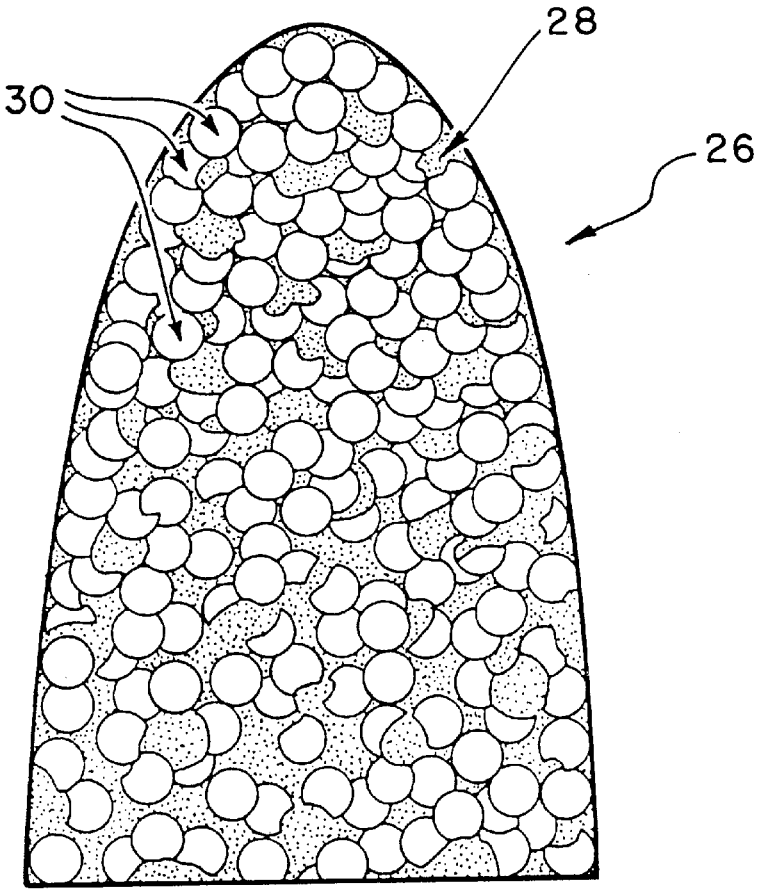
FIG. 3 is a vertical cross-sectional view of a bullet according to the present invention.

FIG. 3 shows a solid body 26 having a desirable projectile shape. The body 26 is illustrated in cross-section, and shows the binder constituent 28 which was not coated on the harder constituent 30. Because the softer binder material 28 flows around the harder constituent 30 under sufficient pressure, the harder constituent 30 is not exposed on the outer surface of the body 26. Thus, the softer material will be in contact with the gun barrel and thereby avoid abrasion from the harder constituent 30.

Figure 4:
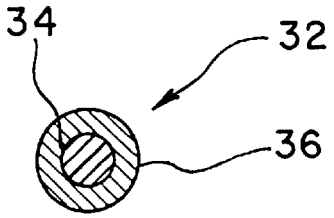
FIG. 4 is a sectional view of a coated shot according to the present invention.

FIG. 4 shows a spherical shot 32 according to the present invention. The shot 32 may consist of a single sphere 34 made of a harder constituent metal, with a coating 36 made of softer, less dense material. While appearing similar in structure to the coated powder of FIG. 2, the shot pellet 32 of FIG. 4 is a single sphere, not a pressed agglomeration of powder.

Figure 5:
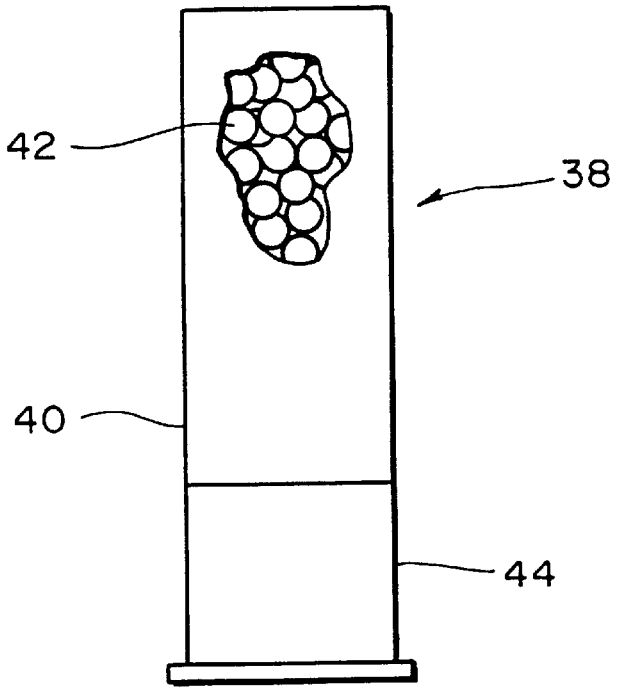
FIG. 5 is a side elevational view, partially cut-away, of a shotshell according to the present invention.
Figure 6:
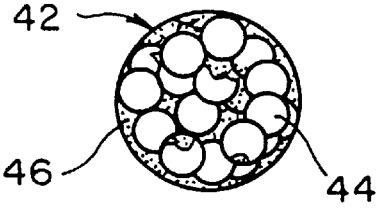
FIG. 6 is an enlarged cross-sectional view of a shot used in the shotshell of FIG. 5.

A more preferred form of shot is illustrated in the embodiment of FIGS. 5 and 6. Referring to FIG. 5, a shotshell 38 includes a tube 40 containing a quantity of shot 42, and a head 44 which includes a primer (not shown). The construction of the shotshell 38 is conventional except that the shot 42 is made according to the present invention.

As shown in FIG. 6, each shot 42 can be made of a hard constituent material 44 and a relatively soft constituent material 46. The constituent materials can be two powders, or a mixture of powders, selected as per the disclosure herein. Alternatively, the shot 42 could be made by consolidating a coated powder into spherical shapes.

Choice of Basic Materials

The base constituent is a powder made of virtually any non-lead material, or mixture of materials, that has a density greater than lead. As noted above, the base constituent may be a metal, metal compound, metal alloy, or a mixture of metals, metal compounds and/or metal alloys. An example of a suitable compound is tungsten carbide, while suitable elements include tungsten and tantalum.

The base constituent materials are typically of relatively high strength and hardness, compared to the binder constituent. This is to ensure that the binder constituent acts as the binder, and not visa versa, and thereby flows to the outer surface of the projectile. This ensures that the softer constituent will form a buffer between the harder base constituent and the gun barrel.

Lead and other toxic materials are specifically excluded as possible base constituents.

The binder constituent is preferably lighter than lead and is softer than the base constituent. Examples of elements capable of use as the binder constituent include, but are not limited to, aluminum, bismuth, copper, tin and zinc, which are more environmentally acceptable than lead. The binder constituent may be elemental, compounded or alloyed as noted with respect to the base constituent, and may also comprise a mixture of elements, compounds and/or alloys, depending on the physical properties of each and the desired physical properties of the finished product.

Selective Density and Frangibility

According to the present invention, the choice and ratio of materials can be selected to achieve a desired density and thus ballistic characteristic. Frangibility is controlled through choice and ratio of materials and consolidation technique. Particle size also has a bearing on consolidation and thus contributes to frangibility control. Thus, to obtain a projectile having a density similar to that of a lead-containing equivalent, materials are selected and provided in ranges that produce the desired overall density. To obtain a projectile having, in addition to a desired density, a desired frangibility, a consolidation technique is selected to achieve a desired fracture toughness, or other physical property. For example, an annealing step provided after cold pressing will change the hardness and/or fracture toughness of the projectile. Additionally, frangibility is also a function of the degree of densification (expressed as a percentage of theoretical maximum density) and the type of consolidation technique, such as cold pressing. Powder size will to a certain extent effect the ability to consolidate the powders and the porosity of the end product.

Choices of materials and process conditions to achieve particular examples of projectiles according to the present invention are described in the following examples:

Example 1

Tungsten particulates 500–1,000 μm (20–40 mils) in diameter were coated with 50–70 μm (2–3 mils) of aluminum employing a chemical vapor deposition (CVD) technique. A 9.6 g (148 grain) sample of the coated particulates was weighed and placed into the cavity of a cylindrical steel die with a diameter of 0.356 inches. The powder sample was subjected to pressure ranging from 140 to 350 Mpa at room temperature.

Once the chosen pressure was achieved, the pressure was held for approximately 5 seconds to ensure complete compaction. The part was removed form the die as a bullet or "slug" and characterized.

The density of each sample was measured for those pressed at 350 Mpa, the average density of the slugs was 10.9 g/cm$^3$ or ≈95% the theoretical density of lead. The room temperature compressive strength of the pressed samples was 145 Mpa, which is adequate for use as projectiles in small arms, specifically 38 caliber and 9 mm pistols.

Example 2

Same as Example 1, except for tungsten carbide spheres, ball point pen balls, with a diameter of 0.051 inches (1.3 mm) were used. A 125 μm (5 mil) thick aluminum coating was applied again using a CVD technique. Similar results were achieved as in Example 1.

Example 3

Pellets or shot used in shotguns are made of non-lead materials and have densities to match or approximate lead or lead alloys currently available. The shot has a soft outer coating which overcomes the problem of steel shot abrading inner surfaces of gun barrels. The ability of this outer coating to deform, due to its inherent softness compared to steel, is what avoids barrel deformation and wear.

The properties of the shot are tailored for specific applications. For example, duck and geese hunters require shot with extended range and good penetration. A dense hard pellet would thus give optimum performance in this application. Target shooters, on the other hand, prefer light charges of smaller diameter lighter weight shot. This product could permit customized loads and result in improved performance as compared to currently available ammunition.

It is also possible to include variations in coating or plating of the particulates. More complex combinations of metals, such as ternary compositions, could also be employed.

Various combinations of hard and soft materials which are combined to form a shot projectile are shown below in Table I. These have densities matching or approximating pure lead, using metal coated tungsten and tungsten carbide spheres:

TABLE I

| Materials (core - shell) | Approximate Shot Size (number) | Core Diameter (in) | Coating Thickness (in) |
|---|---|---|---|
| Tungsten core, various coating materials | | | |
| W—Al | 6 | 0.088 | 0.011 |
| W—Bi | 6 | 0.063 | 0.026 |
| W—Cu | 6 | 0.066 | 0.020 |
| W—Sn | 6 | 0.074 | 0.016 |
| W—Zn | 6 | 0.074 | 0.016 |
| Tungsten carbide core, various coating materials | | | |
| WC—Al | 6 | 0.100 | 0.007 |
| WC—Bi | 6 | 0.070 | 0.019 |
| WC—Cu | 6 | 0.076 | 0.015 |
| WC—Sn | 6 | 0.090 | 0.012 |
| WC—Zn | 6 | 0.090 | 0.012 |
| Tungsten core, tin coating, various shot sizes | | | |
| W—Sn | 6 | 0.076 | 0.01 |
| W—Sn | 4 | 0.090 | 0.019 |
| W—Sn | 2 | 0.106 | 0.023 |
| W—Sn | BB | 0.125 | 0.027 |
| W—Sn | F | 0.152 | 0.033 |
| W—Sn | OO | 0.230 | 0.050 |

Example 4

A mixture of 30 wt. % 320 mesh tin and 70 wt. % 100 mesh tungsten powders was prepared by dry blending the as-received materials. A 9.6 g (148 grain) sample of blended powder was weighed and placed into the cavity of a cylindrical steel die with a diameter of 0.356 inches and placed under the ram of a hydraulic press. The powder sample was subjected to pressures ranging from 140 to 350 Mpa at room temperature. Once the chosen pressure was achieved, the pressure was held for about 5 seconds. The part was removed from the die and characterized.

Density was measured for samples pressed at 350 Mpa, the average density of the slugs was 11.45 g/cm$^3$ or about 100% the theoretical density of lead. The room-temperature compressive strength of the W-Sn part was about 140 Mpa and the part exhibited almost ductile behavior.

In addition to the cylindrical specimens resembling double-ended wadcutter bullets, truncated cone projectiles of the same diameter and weight (0.356 inches and 148 grains) were also prepared in a similar manner. Ammunition was assembled using the bullets. Pistol ammunition for a 38 caliber revolver with velocities of approximately 900 ft/second was prepared as described in the Speer Reloading manual. The ammunition was fired from a revolver with a 4 inch barrel at an outdoor range. The ammunition using the W-Sn bullets performed as well as similarly constructed ammunition using lead counterparts of similar geometry.

Example 5

Same as Example 3 except for the metal mixture containing 30 wt. % 100 mesh tin and 70 wt. % 100 mesh tungsten. The average density of the parts pressed at 350 Mpa was 11.4 g/cm$^3$, 100% that of lead, with an average compressive strength of 130 Mpa, as shown in Table IV.

Example 6

Same as Example 3 except for metal mixture containing 5 wt. % 320 mesh aluminum and 95 wt. % 100 mesh tungsten. The average density of the parts pressed at 350 Mpa ws 10.9 g/cm$^3$, which is 96% that of lead, with an average compressive strength of 200 Mpa, as shown in Table IV.

Example 7

Same as Example 3 except for metal mixture containing 20 wt. % 320 mesh copper and 80 wt. % 100 mesh tungsten. The average density of the parts pressed at 350 Mpa was 11 g/cm$^3$, 97% that of lead, with an average compressive strength of 220 Mpa.

Example 8

Same as Example 3 except for the metal mixture containing 40 wt. % 100 mesh zinc and 60 wt. % 100 mesh tungsten. The average density of the parts pressed at 350 Mpa was 10.9 g/cm$^3$, 96% that of lead, with an average compressive strength of 145 Mpa.

Example 9

Same as Example 3 except for metal mixture containing 70 wt. % 100 mesh bismuth and 30 wt. % 100 mesh tungsten. The average density of the parts pressed at 350 Mpa was 10.9 g/cm$^3$, 96% that of lead.

Materials for use as the high density constituent include tungsten, tungsten carbide, tantalum, and any non-lead metals, metal alloys or other materials with similar densities. Coating metals include aluminum, bismuth, copper, tin, zinc, and other non-lead metals with similar properties. Density and frangibility can be customized for individual needs, by considering the density and mechanical properties of the individual constituents. The following Tables II and III serve as guidelines for material selection:

TABLE II

| Material | Symbol | Density (g/cm$^3$) | Modulus (GPa) | Strength (MPa) | Hardness (VHN) |
|---|---|---|---|---|---|
| Lead | Pb | 11.36 | 14 | 13 | 0.049 |
| Lead + 0.01% Tin | Pb/Sn | 11.34 | 14 | 18 | 5 HB* |
| Lead + 5% Tin | Pb/Sn | 11.00 | | 23 | 8 HB* |
| Lead + 20% Tin | Pb/Sn | 10.20 | | 40 | 11.3 HB* |
| Lead + 50% Tin | Pb/Sn | 8.89 | | 42 | 14.5 HB* |
| Lead + 4% Antimony | Pb/Sb | 11.02 | | 100 | 8.1 HB* |
| Copper | Cu | 8.93 | 130 | 200 | 0.50 |
| Bismuth | Bi | 9.81 | 32 | NA | 0.095 |
| Gold | Au | 19.30 | 78 | 100 | 0.66 |
| Silver | Ag | 10.49 | 70 | 125 | 0.94 |
| Platinum | Pt | 21.45 | 170 | 140 | 0.86 |
| Aluminum | Al | 2.70 | 60 | 45 | 0.25 |
| Tungsten | W | 19.25 | 415 | 3450 | 3.43 |
| Tin | Sn | 7.29 | 15 | 15 | 0.071 |
| Iron | Fe | 7.87 | 170 | 600 | 0.65 |
| Molybdenum | Mo | 10.22 | 310 | 500 | 0.38 |
| Nioblum | Nb | 8.57 | 100 | 275 | 0.86 |
| Tantalum | Ta | 16.6 | 190 | 360 | 1.06 |
| Titanium | Ti | 4.51 | 200 | 235 | 1.54 |
| Low Carbon Steel | Fe—FeC | 7.5 | 200 | 350 | 90 HB* |
| Tungsten Carbide | WC | 15.0 | 640 | 1500 | 18.44 |
| Zinc | Zn | 7.13 | 70 | 135 | 0.02 |

*The hardness of lead is 3 HB in similar units.

TABLE III

| Material | Symbol | Health Rating | Comments from "Sax and Lewis" | MSDS Acute Exposure | MSDS Chronic Exposure | TLV/TWA (mg/m$^3$) |
|---|---|---|---|---|---|---|
| Lead | Pb | 4 | poison, carcinogen, teratogen, lead poisoning most common of occupational diseases | numerous difficulties, see MSDS | see MSDS | 0.07–0.2 (0.05) |
| Cooper | Cu | 4 | metal and powder not problems, fumes only | ulcers, pneumonia | anemia | NA (1) |
| Bismuth | Bi | 1 | industrially not considered toxic | mild irritant | nervous systems | NA (NE) |
| Gold | Au | 3 | none | | | NA |
| Silver | Ag | 3 | skin pigmentation effects | | | 0.1 |
| Aluminum | Al | 1 | dust possibly associated with pulmonary fibrosis, Alzheimer's | mild irritant | Alzheimer's | 10 (10) |
| Tungsten | W | 2 | industrially not considered toxic | NISS | HM disease pneumonia | 5 (5) |
| Tin | Sn | 2 | not considered toxic | mild irritant | pneumonia | 2 (2) |
| Iron | Fe | 2 | as dust can be irritant and possibly poisonous | oxide dust irritant | oxide mottling of lungs | NA (5) |
| Tantalum | Ta | 3 | considered nontoxic, industrial poisoning not recorded | | | 5.0 |

TABLE III-continued

| Material | Symbol | Health Rating | Comments from "Sax and Lewis" | MSDS Acute Exposure | MSDS Chronic Exposure | TLV/TWA ($mg/m^3$) |
|---|---|---|---|---|---|---|
| Titanium | Ti | 1 | considered physiological inert | nuisance | irritant | NA (NE) |
| Molybdenum | Mo | 1 | human poisoning by inhalation not been documented | irritant | pneumonia | 15 |
| Low carbon Steel | Fe—FeC | 2 | see iron and other steel additives | | | 10 |
| Zinc | Zn | 2 | dust and powder nontoxic to humans | NISS | dermatitis | NA (10) |

Table IV shows a variety of processed projectiles having a range of densities from 90 to 120% of lead and acceptable mechanical properties, as described in Examples 3–8 above. It is apparent from the above data that the physical properties of the shot or bullets can be varied by changing the parameters of the powder compositions. For example, mesh size, densification pressure and ratio of hard to soft metals can be varied to derive a desired degree of frangibility.

TABLE IV

| Composition | Fraction (by wt) | Processing Pressure (MPa) | Density ($g/cm^3$) | % Density of Lead | Compressive Strength (MPa) |
|---|---|---|---|---|---|
| Pb | 100 | na | 11.36 | 100.0 | |
| Pb—Sn | 95/5 | na | 11.00 | | |
| Pb—Sn | 80/20 | na | 10.20 | | |
| W—Sn | 70/30 | 140 | 10.17 | 89.2 | 70 |
| " | | 210 | 10.88 | 95.8 | 95 |
| " | | 280 | 11.34 | 99.9 | 127 |
| " | | 350 | 11.49 | 101.2 | 137 |
| W—Sn* | 58/42 | 140 | 9.76 | 85.9 | 84 |
| " | | 210 | 10.20 | 89.8 | 95 |
| " | | 280 | 10.49 | 92.3 | 106 |
| W—Al II | 95/5 | 140 | 9.35 | 82.3 | 57 |
| " | | 210 | 10.06 | 88.6 | 101 |
| " | | 280 | 10.62 | 93.5 | 157 |
| " | | 350 | 10.91 | 96.0 | 200 |
| W—Zn | 60/40 | 350 | 10.85 | 95.5 | 145 |
| Bi—W | 70/30 | 350 | 10.88 | 95.8 | not tested |
| W—Cu | 80/20 | 350 | 10.99 | 96.8 | 220 |

Compressive strengths of lead and lead tin alloys are in a range from 15 to 70 MPa.
Densities of lead and lead-tin alloys are in a range from ≈ 10.70 to 11.36 $g/cm^3$ (pure lead).

Non-lead projectiles according to the present invention are formed using powder metallurgy techniques. Controlling density permits matching of any lead, lead alloys, or copper/lead construction being employed in current bullets. With matched density, the present projectiles have equivalent or comparable weapon function, ballistic properties, and accuracy. The impact behavior of the projectiles is also controllable through changes in composition and processing. Components with a broad range of frangibility or impact properties can be fabricated thus meeting the needs of many users for a wide variety of applications. Processing is simple, involving only the cold pressing of powders.

The use of coated powders improves reproducibility and uniformity, and prevents wear of barrels by preventing contact by the harder high density metal. Sintering may permit a greater level of flexibility in compositions and properties.

The projectiles described herein could replace any bullet in current use that employ lead or other hazardous materials. This would benefit any organization and individual that uses ammunition for training, self defense, police applications, military, hunting, sport shooting, etc. Moreover, the term "projectile" refers to any munitions round, or the core to a munitions round. For example, the projectiles of the present invention could be the core of a jacketed round.

Figure 7:
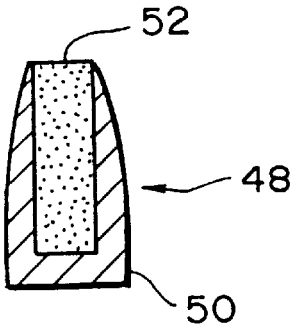
FIG. 7 is a cross-sectional view of a jacketed bullet according to the present invention.

An example of a jacketed round can be found in FIG. 7, wherein a bullet 48 has an outer jacket 50, made of suitable jacketing material (typically, copper or a copper alloy known as gilding metal is used as a jacket material, although other non-traditional materials may be desirable for environmental reasons), and an inner core 52 made of the non-lead materials described herein. The amount, mixture and type of materials are selected according to the desired ballistic properties of the projectile as per the present invention. Also, the forming techniques can be such that the core is preformed or formed in the jacket as by swaging. In either event, the amount of consolidation is controlled to achieve desired frangibility characteristics.

The projectiles encompassed in the present invention could include, in addition to bullets, virtually any type of artillery round, such as those capable of exploding on impact (and thus incorporating an explosive charge), a hand grenade, a rocket warhead, etc.

Objects other than munitions projectiles also could be fashioned from the aforementioned materials and techniques. For example, non-lead fishing weights, tire balance weights, or ship's ballast could be made using the present invention. Other uses are easily envisioned, where it is desirable to emulate mechanical and physical properties of a material which is to be replaced, either due to the scarcity or toxicity of the replaced material.

It is known that most of the high density metals of interest are not easily wet by the light metals of choice, e.g., tin does not wet tungsten.

In order to facilitate wetting and thereby enhance bonding between phases and ensure complete consolidation, the present invention includes a method of applying a coating on the high density powders, wherein the coating enhances the wetting properties of the powder. The coatings can be applied to powders and particles employing known fluidized-bed and tumbling-bed chemical vapor deposition (CVD), electroplating, or other metal deposition processes.

A particularly preferred process of coating the more dense, harder powder involves a relatively simple process employing the reduction of a metal salt, nitrates or halides. For example, copper and iron nitrates are dissolved in water and mixed with tungsten powders. The water is then driven off by heating at, for example, 150° C., and as a result, the nitrate is converted to the metal by reduction in hydrogen at 900° C.

A uniform coating of controlled thickness can readily be deposited on powders or particulates of a broad range of sizes and densities. The coated high-density metal powders can then be mixed with the lighter, softer metals and then mixed and cast. Alternatively, the porous compacts of the coated high density metal powders can be fabricated and melt infiltrated with the softer metal. "Melt infiltration" is a process by which the liquid metal is wicked into the porous body through capillary action or forced in by pressure. The process can only be applied if the liquid wets the surfaces of the porous preform.

Figure 8:
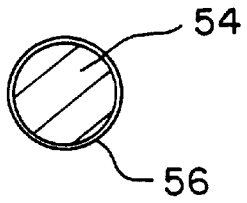
FIG. 8 is an enlarged cross-sectional view of a particle of relatively dense material having a wet-enhancing coating formed thereon.
Figure 9:
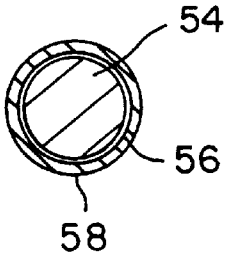
FIG. 9 is an enlarged cross-sectional view of the particle of FIG. 8, having a coating of relatively less dense, softer material formed over the wet-enhancing coating.

Referring to FIG. 8, a spherical particle 54 made of a relatively dense and hard material, such as tungsten, is provided with a coating 56 of a material which improves the wetting of the tungsten vis-a-vis a second, relatively softer and less dense material. The second material can be coated over the coating 56 to form an outer coating 58, as shown in FIG. 9.

Alternatively, the relatively softer material, in powder or particulate form, can be mixed with the harder material having the coating 56 formed on each powder and then the mixed powders can be pressed or otherwise consolidated as per the methods described herein.

Containers Having Controlled Frangibility

The methods and materials described above can be used to fabricate explosives containers having controlled frangibility. Existing containers are typically made of pure metals, metal alloys, and polymer-metal mixtures. The powders described above can be used to produce containers that exhibit variable disintegration behavior, i.e., controlled frangibility, and have the added value of maintaining or increasing the reactive mass over current containers.

Using the materials and metallurgical techniques described above, explosives containers can be fabricated by blending metal powders and particulates, and pressing (or otherwise consolidating) at either ambient or elevated temperatures in order to control the frangibility properties. The high density metal is mixed with lighter and softer metals, as in the case of lead-free projectiles, and pressed to form containers. The high density metal provides mass while the softer metal acts as a binder. The pressure, temperature and/or powder/particle size can be selected to control the ductility and frangibility of the formed material.

The high density metals and metal compounds of particular interest include, but are not limited to, tungsten, molybdenum, and tungsten carbide. The lighter, softer metals include, but are not limited to, aluminum, bismuth, copper, tin, and zinc.

The composition, particle sizes, and processing conditions affect density and mechanical behavior, i.e., disintegration properties and frangibility. Mixtures of metal powders can be pressed (and if necessary sintered) to produce a container. Containers can be pressed to specific shapes, and processing condition and composition can be altered to control density, ductility, and disintegration properties, i.e., frangibility.

Controlling density and ductility permits matching the initial containment of the expanding gases to the application. This also allows expanded design parameters for shaped charges. The disintegration behavior of the container is also controllable through changes in composition and processing. Components with a broad range of frangibility or disintegration properties can be fabricated thus meeting the needs of many users for a wide variety of applications.

The size, shape, and properties of the high density powder/particulate can also be altered to control effectiveness and damage zone of the device. Larger, harder, heavier particles will exhibit quite different properties than fine, low density particulates. Consolidation of blended powder can be by hot or cold pressing, isostatic pressing or any other suitable means. It is understood that the selection of consolidation technique may be determined by the physical properties sought in the preform.

The containers could have virtually any shape, and could be used with any explosive. They could be used in any explosive charge from bulk to shaped charges. Components could be direct replacement for all explosive containers in current use, including those used in the fields of demolition, mining, and oil exploration.

Figure 10:
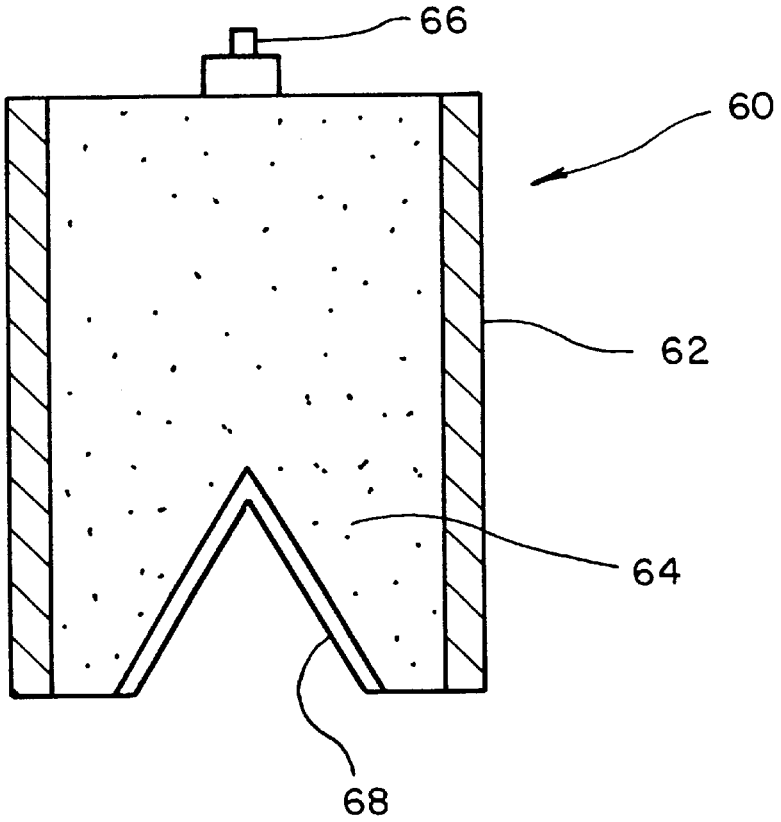
FIG. 10 is vertical cross-sectional view of an explosive device having a container manufactured according to the present invention.

An example of a container for a shaped charge 60 is found in FIG. 10, in which a container or case 62 contains a lined, explosive charge 64 made of high explosive material. A detonator 66 can be provided at one end of the charge 60. The liner 68 is shown in a particular, but non-limiting, shape. The physical properties of the container 60 are dictated by the selection of materials and process conditions which are used to form same. The case 62 can thus be made more or less frangible to achieve a desire result.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A projectile formed of a non-sintered solid body comprising:

a base constituent having a density higher than lead;

a lead-free binder constituent made of a metallic phase and having sufficient malleability and ductility to bind together with the base constituent into a solid body of desired shape when subjected to a consolidation process without sintering; and a wetting constituent of a type and quantity sufficient to increase the wetting capacity of the base constituent by the binder constituent.

2. A projectile according to claim 1, wherein the base constituent is a powder, and the wetting constituent is coated on the base constituent.

3. A projectile according to claim 1, wherein the base constituent is one of a metal, metal alloy, metal compound, and any mixtures thereof.

4. A projectile according to claim 3, wherein the base constituent is made of a material selected from the group consisting of tungsten, tungsten carbide, tantalum and any mixtures, alloys or compounds thereof.

5. A projectile according to claim 1, wherein the binder constituent is one of a metal, metal alloy, metal compound, and any mixtures thereof.

6. A projectile according to claim 5, wherein the binder constituent is selected from the group consisting of aluminum, bismuth, copper, tin, and zinc and any mixtures, alloys or compounds thereof.

7. A projectile according to claim 1, wherein the base constituent and the binder constituent are made of materials and provided in ratios selected to achieve a desired density of the solid body.

8. A projectile according to claim 7, wherein the solid body has a theoretical density substantially similar to that of lead.

9. A projectile according to claim 1, wherein the base constituent and the binder constituent are made of materials, provided in ratios, and subjected to consolidation process parameters selected to achieve a desired density and frangibility of the solid body.

10. A projectile according to claim 1, wherein the base constituent is made of a material selected from the group consisting of tungsten, tungsten carbide, and tantalum, and the binder constituent is selected from the group consisting of aluminum, bismuth, copper, tin, zinc, and any mixtures, alloys or compounds thereof.

11. A projectile according to claim 1, wherein the base constituent is a powder having a diameter in the range of 500–1,000 μm, and the binder constituent is coated on each powder particle, each coating having a thickness of between 50–70 μm.

12. A projectile according to claim 1, wherein the amount of the base constituent relative to the binder constituent is about 1–99 weight percent.

13. A projectile according to claim 1, wherein the base constituent is one of a powder and a mixture of powders, and the binder constituent is one of a powder and a mixture of powders, the base constituent and the binder constituent being evenly distributed to form a blend prior to consolidation.

14. A projectile according to claim 13, wherein the base constituent comprises 1–99 weight percent of the blend.

15. A projectile according to claim 1, wherein the base constituent is tungsten and the binder constituent is tin.

16. A projectile according to claim 15, wherein the base constituent and the binder constituent are evenly distributed to form a blend prior to consolidation, and the blend comprises about 70 weight percent tungsten as the base constituent, and the remainder tin as the binder constituent, and the wetting constituent.

17. A projectile according to claim 16, wherein the tungsten powder is about 100 mesh and the tin powder is about 320 mesh.

18. A projectile according to claim 16, wherein the tungsten powder is about 100 mesh and the tin powder is about 100 mesh.

19. A projectile according to claim 1, wherein the base constituent is tungsten and the binder constituent is aluminum.

20. A projectile according to claim 19, wherein the base constituent and the binder constituent are evenly distributed powders which form a blend prior to consolidation, and the blend comprises about 95 weight percent tungsten as the base constituent and the remainder aluminum as the binder constituent, and the wetting constituent.

21. A projectile according to claim 20, wherein the tungsten powder is about 100 mesh and the aluminum powder is about 320 mesh.

22. A projectile according to claim 1, wherein the base constituent is tungsten and the binder constituent is copper.

23. A projectile according to claim 22, wherein the base constituent and the binder constituent are evenly distributed powders which form a blend prior to consolidation, and the blend comprises about 80 weight percent tungsten as the base constituent and the remainder copper as the binder constituent, and the wetting constituent.

24. A projectile according to claim 22, wherein the tungsten is a 100 mesh powder and the copper is a 320 mesh powder.

25. A projectile according to claim 1, wherein the base constituent is tungsten and the binder constituent is zinc.

26. A projectile according to claim 25, wherein the base constituent and the binder constituent are evenly distribute powders which form a blend prior to consolidation, and the blend comprises about 60 weight percent tungsten as the base constituent and the remainder zinc as the binder constituent, and the wetting constituent.

27. A projectile according to claim 26, wherein the tungsten is a 100 mesh powder and the zinc is a 100 mesh powder.

28. A projectile according to claim 1, wherein the base constituent is tungsten and the binder constituent is bismuth.

29. A projectile according to claim 28, wherein the base constituent and the binder constituent are evenly distributed powders which form a blend prior to consolidation, and the blend comprises about 30 weight percent tungsten as the base constituent and the remainder bismuth as the binder constituent, and the wetting constituent.

30. A projectile according to claim 28, wherein the tungsten is a 100 mesh powder and the bismuth is a 100 mesh powder.

31. A container for explosives formed of a non-sintered solid body comprising:

a base constituent having a density higher than lead;

a lead-free binder constituent made of a metallic phase and having sufficient malleability and ductility to bind together with the base constituent into a solid body of desired shape when subjected to a consolidation force, and a wetting constituent having the capacity to increase the wetting capacity of the base constituent by the binder constituent, the base constituent and the binder constituent being sized, apportioned, and consolidated in a manner selected to achieve a desired frangibility, thereby providing controllability of at least one of a direction, force and fragmentation of explosion.

32. A container according to claim 31, wherein the base constituent is a powder, and the wetting constituent is coated on the base constituent.

33. A container according to claim 31, wherein the base constituent is one of a metal, metal alloy, metal compound, and any mixture thereof.

34. A container according to claim 33, wherein the base constituent is made of a material selected from the group consisting of tungsten, tungsten carbide, tantalum, and any mixtures, alloys, or compounds thereof.

35. A container according to claim 31, wherein the binder constituent is one of a metal, metal alloy, metal compound, and any mixture thereof.

36. A container according to claim 35, wherein the binder constituent is selected from the group consisting of aluminum, bismuth, copper, tin, and zinc.

37. A container according to claim 31, wherein the base constituent and the binder constituent are made of materials and provided in ratios selected to achieve a desired density of the solid body.

38. A container according to claim 31, wherein the solid body has a theoretical density substantially similar to that of lead.

39. A container according to claim 31, wherein the base constituent and the binder constituent are made of materials, provided in ratios, and subjected to consolidation process parameters selected to achieve a desired density and frangibility of the solid body.

40. A non-sintered container according to claim 31, wherein the base constituent is made of a material selected from the group consisting of tungsten, tungsten carbide, and tantalum, and the binder constituent is selected from the group consisting of aluminum, bismuth, copper, tin, zinc, and any mixtures, alloys or compounds thereof.

41. A composite material comprising:

a base constituent having a density higher than lead;

a lead-free binder constituent made of a metallic phase and having sufficient malleability and ductility to bind together with the base constituent into a solid body of desired shape when subjected to a consolidation force without sintering; and a wetting constituent having the capacity to increase the wetting capacity of the base constituent by the binder constituent.

42. A composite material according to claim 41, wherein the base constituent is a powder, and the wetting constituent is coated on the base constituent.

43. A composite material according to claim 41, wherein the base constituent is one of a metal, metal alloy, metal compound, and any mixtures thereof.

44. A composite material according to claim 43, wherein the base constituent is made of a material selected from the group consisting of tungsten, tungsten carbide, tantalum and any mixtures, alloys or compounds thereof.

45. A composite material according to claim 41, wherein the binder constituent is one of a metal, metal alloy, metal compound, and any mixtures thereof.

46. A composite material according to claim 45, wherein the binder constituent is selected from the group consisting of aluminum, bismuth, copper, tin, and zinc and any mixtures, alloys or compounds thereof.

47. A composite material according to claim 41, wherein the base constituent and the binder constituent are made of materials and provided in ratios selected to achieve a desired density of the solid body.

48. A composite material according to claim 47, wherein the solid body has a theoretical density substantially similar to that of lead.

49. A composite material according to claim 41, wherein the base constituent and the binder constituent are made of materials, provided in ratios, and subjected to consolidation process parameters selected to achieve a desired density and frangibility of the solid body.

50. A composite material according to claim 41, wherein the base constituent is made of a material selected from the group consisting of tungsten, tungsten carbide, and tantalum, and the binder constituent is selected from the group consisting of aluminum, bismuth, copper, tin, zinc, and any mixtures, alloys or compounds thereof.

51. A composite material according to claim 41, wherein the base constituent is a powder having a diameter in the range of 500–1,000 $\mu$m, and the binder constituent is coated on each powder particle, each coating having a thickness of between 50–70 $\mu$m.

52. A composite material according to claim 41, wherein the amount of the base constituent relative to the binder constituent is about 1–99 weight percent.

53. A composite material according to claim 41, wherein the base constituent is one of a powder and a mixture of powders, and the binder constituent is one of a powder and a mixture of powders, the base constituent and the binder constituent being evenly distributed to form a blend prior to consolidation.

54. A composite material according to claim 53, wherein the base constituent comprises 1–99 weight percent of the blend.

55. A composite material according to claim 41, wherein the base constituent is tungsten and the binder constituent is tin.

56. A composite material according to claim 55, wherein the base constituent and the binder constituent are evenly distributed to form a blend prior to consolidation, and the blend comprises about 70 weight percent tungsten as the base constituent, and the remainder tin as the binder constituent, and the wetting constituent.

57. A composite material according to claim 56, wherein the tungsten powder is about 100 mesh and the tin powder is about 320 mesh.

58. A composite material according to claim 56, wherein the tungsten powder is about 100 mesh and the tin powder is about 100 mesh.

59. A composite material according to claim 41, wherein the base constituent is tungsten and the binder constituent is aluminum.

60. A composite material according to claim 41, wherein the base constituent and the binder constituent are evenly distributed powders which form a blend prior to consolidation, and the blend comprises about 95 weight percent tungsten as the base constituent and the remainder aluminum as the binder constituent, and the wetting constituent.

61. A composite material according to claim 60, wherein the tungsten powder is about 100 mesh and the aluminum powder is about 320 mesh.

62. A composite material according to claim 41, wherein the base constituent is tungsten and the binder constituent is copper.

63. A composite material according to claim 62, wherein the base constituent and the binder constituent are evenly distributed powders which form a blend prior to consolidation, and the blend comprises about 80 weight percent tungsten as the base constituent and the remainder copper as the binder constituent, and the wetting constituent.

64. A composite material according to claim 63, wherein the tungsten is a 100 mesh powder and the copper is a 320 mesh powder.

65. A composite material according to claim 41, wherein the base constituent is tungsten and the binder constituent is zinc.

66. A composite material according to claim 41, wherein the base constituent and the binder constituent are evenly distributed powders which form a blend prior to consolidation, and the blend comprises about 60 weight percent tungsten as the base constituent and the remainder zinc as the binder constituent, and the wetting constituent.

67. A composite material according to claim 66, wherein the tungsten is a 100 mesh powder and the zinc is a 100 mesh powder.

68. A composite material according to claim 41, wherein the base constituent is tungsten and the binder constituent is bismuth.

69. A composite material according to claim 41, wherein the base constituent and the binder constituent are evenly distributed powders which form a blend prior to consolidation, and the blend comprises about 30 weight percent tungsten as the base constituent and the remainder bismuth as the binder constituent, and the wetting constituent.

70. A composite material according to claim 69, wherein the tungsten is a 100 mesh powder and the bismuth is a 100 mesh powder.

71. An article comprising:

a solid body made of a composite material, the composite material including a base constituent having a density higher than lead, a lead-free binder constituent made of a metallic phase and having sufficient malleability and ductility to bind together with the base constituent to form the solid body of desired shape when subjected to a consolidation force without sintering, and a wetting constituent having the capacity to increase the wetting capacity of the base constituent by the binder constituent.

72. An article according to claim 71, wherein the solid body is substantially cylindrically shaped and has a cavity for containing explosives.

73. An article according to claim 71, wherein the solid body is substantially spherically shaped.

74. An article according to claim 71, wherein the solid body is substantially cylindrically shaped and is provided with an outer metallic jacket.

75. An article according to claim 71, wherein the solid body is a weight.

* * * * *